US009458383B2

(12) United States Patent
Kim et al.

(10) Patent No.: US 9,458,383 B2
(45) Date of Patent: Oct. 4, 2016

(54) METHOD AND DEVICE FOR BREAKING UP A FRESH AND HOT COKE CHARGE IN A RECEIVING TROUGH

(75) Inventors: Ronald Kim, Essen (DE); Franz-Josef Schuecker, Muelheim an der Ruhr (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 553 days.

(21) Appl. No.: 13/980,940

(22) PCT Filed: Dec. 8, 2011

(86) PCT No.: PCT/EP2011/006168

§ 371 (c)(1),
(2), (4) Date: Jul. 22, 2013

(87) PCT Pub. No.: WO2012/097841

PCT Pub. Date: Jul. 26, 2012

(65) Prior Publication Data

US 2013/0306462 A1 Nov. 21, 2013

(30) Foreign Application Priority Data

Jan. 21, 2011 (DE) ..... 10 2011 009 175

(51) Int. Cl.
*C10B 39/04* (2006.01)
*C10B 39/14* (2006.01)
*C10B 39/08* (2006.01)

(52) U.S. Cl.
CPC ..... *C10B 39/08* (2013.01); *C10B 39/04* (2013.01); *C10B 39/14* (2013.01)

(58) Field of Classification Search
CPC ..... C10B 39/04; C10B 39/08; C10B 39/14
USPC ..... 202/227; 201/39
See application file for complete search history.

(56) References Cited

U.S. PATENT DOCUMENTS 3,876,143 A * 4/1975 Rossow ..... C10B 39/04 202/227
4,083,753 A 4/1978 Rogers et al.
(Continued)

FOREIGN PATENT DOCUMENTS

CN 2668641 1/2005
DE 1253669 11/1967
(Continued)

OTHER PUBLICATIONS

International Search Report for PCT/EP2011/006168, English translation attached to original, Both completed by the European Patent Office on May 12, 2012, All together 5 Pages.

*Primary Examiner* — Jill Warden
*Assistant Examiner* — Joye L Woodard
(74) *Attorney, Agent, or Firm* — Brooks Kushman P.C.

(57) ABSTRACT

A method and a device for breaking up a fresh and hot coke charge in a receiving trough having mobile plate segments, the coke charge being conveyed to a quenching tower in the receiving trough of a flatbed transport car in which the coke charge is cooled down to ambient temperatures by mobile plate segments so that the coke structure is broken up and crevice-type cavities are formed in the compacted coke charge. These crevice-type cavities then allow an increased amount of water to flow into the interior of the coke charge during the subsequent quenching step, resulting in a high profitability of the method, a higher coke quality and a reduced burden on the environment due to reduced quenching times and lower water consumption. A device for carrying out the method is also disclosed.

22 Claims, 6 Drawing Sheets

(56) References Cited

U.S. PATENT DOCUMENTS

| | | | | |
|---|---|---|---|---|
| 4,142,942 | A * | 3/1979 | Calderon | C10B 39/04 202/227 |
| 4,363,702 | A * | 12/1982 | Kucher | C10B 39/14 202/268 |
| 4,842,695 | A | 6/1989 | Schmid et al. | |
| 5,564,340 | A | 10/1996 | Baird et al. | |
| 8,152,970 | B2 | 4/2012 | Barkdoll et al. | |

FOREIGN PATENT DOCUMENTS

| | | |
|---|---|---|
| DE | 102006047226 | 2/2008 |
| EP | 0084786 | 8/1983 |
| EP | 0964049 | 12/1999 |
| WO | 9109094 | 6/1991 |
| WO | 2006089612 | 8/2006 |
| WO | 2007103649 | 9/2007 |

* cited by examiner

METHOD AND DEVICE FOR BREAKING UP A FRESH AND HOT COKE CHARGE IN A RECEIVING TROUGH

CROSS-REFERENCE TO RELATED APPLICATION

This application is the U.S. national phase of PCT Application No. PCT/EP2011/006168 filed on Dec. 8, 2011, which claims priority to German Patent Application No. 10 2011 009 175.0 filed on Jan. 21, 2011, the disclosures of which are incorporated in their entirety by reference herein.

BACKGROUND OF THE INVENTION

1. Field of the Invention

The invention relates to a method and a contrivance for the breaking-up of a fresh and hot coke batch in a receiving container with movable plate segments, with the coke batch being transported in the receiving container of a flat-bed transfer car to a quenching tower, where the coke batch is cooled down to ambient temperatures by using movable plate segments so that the coke structure loosens up and gap-like cavities form in the compacted coke batch, and on account of these gap-like cavities an increased amount of water can flow into the inside of the coke batch during the subsequent quenching process, the reduced quenching time and the lower water consumption for coke quenching resulting in a higher economic efficiency of the method, a higher coke quality and a lower emission load for the environment. The invention also relates to a contrivance for applying this method.

2. Description of the Related Art

Conventional horizontal-type coke-oven chambers are equipped with so-called coke transfer machines on the coke side of the coke-oven batteries, such machines being used for operations to be performed in connection with the coke-sided pushing of the carbonised coke. Normally the coke quenching device is a quenching car which can be—at least partly—moved separately underneath the coke transfer machine. The quenching car typically includes a receiving container which takes up the coke from the coke-oven chamber and takes it to the quenching tower. Between the receiving container and the coke-oven chamber there is frequently a coke transfer machine which, in a simple case, may consist of a wharf or a sloped plate and ensures, by integral suction devices, that the emissions produced when the coke drops out of the oven are evacuated into a dust extraction system, thereby minimising the environmental load. The quenching car typically travels on rails and can be moved directly below the quenching tower by means of a transport device. The quenching tower is a wet-quenching tower according to an embodiment frequently used but it can also be a dry-quenching tower.

The coal-to-coke carbonisation is frequently carried out in so-called heat-recovery or non-recovery-type coke-oven chambers. Modern coke ovens of the heat-recovery or non-recovery-type are not equipped with such extracting transfer machines. After carbonisation, the coke is here pushed into a flat-bed quenching car which is on the same level as the lower edge of the oven, thereby avoiding the production of emissions when pushing the coke, as the coke cake does not drop vertically out of the oven.

In the practice of coke-oven engineering, the coke is considered fully carbonised if the content of volatile components is below 1.8 weight percent (wt.-%). These volatile residual components are distributed heterogeneously inside the coke batch and normally burn if they are exposed to an oxygen-bearing ambient atmosphere. The coke is normally pushed into this quenching car at average temperatures between 900 and 1100° C. When pushing has been completed, the quenching car is moved to the quenching tower. In the quenching tower the coke is then cooled to temperatures of approx. 100° C. by supplying water.

A typical contrivance including a quenching car for wet quenching is described in DE 1253669 B. The invention relates to a contrivance for the quenching of coke that has been discharged from horizontal coking chambers, the contrivance consisting of a stationary quenching compartment with stack-like part and travelling along the oven battery on the coke side or being supplied from a receiving car or from a receiving car for glowing coke, and a coke receiving compartment which is followed by a circulating conveying grid with spraying system on top, in which tube bundles containing heatable process fluid are installed above the conveying grid between the device for controlling the height of the coke layer and the spraying system, these tube bundles possibly communicating with the known tube bundles of the coke receiving compartment. Embodiments of a quenching car and its control system are disclosed by WO 2006/089612 A1, U.S. Pat. No. 5,564,340 A and EP 964049 A2.

There are also embodiments where the coke is quenched from below by supplying water. Such embodiment is also called "bottom quenching". It is also common practice to combine both quenching methods. Typical embodiments of a dry quenching method are disclosed by WO 91/09094 A1 and EP 0084786 B1.

Transport of the coke can be carried out in quenching cars of the flat-bed type or quenching cars with receiving container. Flat-bed quenching cars are described in CN 2668641 Y, for example. Quenching cars with receiving container are described in U.S. Pat. No. 5,564,340 A, for example. The coke does not burn at first, as an ash layer of up to 30 mm forms at the upper edge of the coal batch by combustion of the uppermost coal layers during the first hours of the carbonisation process due to direct heating. This ash layer largely protects the coke from further combustion during transport to the quenching tower. In this way the emissions remain within tolerable limits and can be sucked off during the transport by suitable extraction devices if required.

Coke quenching systems have normally been designed assuming that coke densities are between 400 and 600 $kg*m^{-3}$ and the vertical height of the coke cake is approx. 1000 mm. To improve the economic efficiency, the initial coal densities of 850 to 1200 $kg*m^{-3}$ have recently been raised. The coke cake densities obtained from carbonisation are therefore above the known range of 400 to 600 $kg*m^{-3}$ and also cause sealing of the coke cake surface. The result is that the quenching water cannot penetrate vertically into the batch or only with delay.

The coke is then quenched in the quenching tower. The high degree of compaction of the coal cake and of the coal cake obtained from carbonisation makes it impossible for the quenching water to penetrate vertically into the batch or only with delay. In this way the cooling effect is retarded.

An additional impedance to the effective cooling of the fresh coke batch is the so-called "Leidenfrost effect". As the temperature of the coke batch is high, the water impinging on the surface of the hot coke will evaporate instantaneously. As a result a coat of water vapour forms around the coke pieces preventing the entry of further water. The water impinging on the surface of the coke forms a protective vaporous coat for a limited period of time and protects the coke from direct heat transfer. In this way the water cannot penetrate efficiently into the inside of the coke and therefore flows off laterally not reaching the inner coke layers.

In this way the quenching water is distributed unevenly across the entire volume of the coke batch. As this also results in uneven cooling by the quenching water, the temperature distribution across the coke batch will likewise be uneven. Hence there will still be parts of the coke cake after quenching that show a coke temperature of more than 100° C. This is a significant problem when processing and using the coke downstream as coke batch portions of temperatures above 100° C. can damage transport and conveying belts which are frequently made of hard rubber or plastics. The quenched coke will thus also consist of partial batches the water content of which is above 3 wt.-%. An elevated water content of more than 3 wt.-% in the coke is also a problem as the water will diminish the product quality of the raw iron in the downstream blast-furnace process.

The aim in the processes of pushing and quenching of produced coke cakes is to reduce the emissions or to eliminate them as completely as possible. The emissions can be reduced by transporting the coke cake to the quenching tower after the end of the pushing process without any further mechanical treatment. The ash layer produced by the combustion of the uppermost coal layers largely protects the coke from further combustion during transport to the quenching tower and does not produce any emissions unless it is whirled up.

SUMMARY OF THE INVENTION

It is therefore the aim to provide a method which allows quenching and cooling of the glowing coke in the quenching tower immediately after the end of the pushing process while preventing uneven temperature distribution or water content in the coke batch and at the same time reducing pollution.

The invention achieves this aim by a method that uses a plate above the bottom plate of the receiving container of a quenching car, the plate being subdivided into movable segments which are moved or lifted against one another above the bottom of the receiving container by a controllable driving unit shortly before or during the quenching process so that the fresh coke batch rips up and forms additional gaps, channels and clear edge areas in the coke into which the cooling agent can flow from the cooling agent nozzles arranged above, and the cleared areas of the coke batch can be wetted by the cooling agent.

Thus a method is provided which actively supports the process of quenching a coke cake during the quenching in the quenching tower so that the quenching process can be adapted to meet the conditions of the coke cake and of the quenching tower.

Particular claim is laid to a method for breaking up a fresh and hot coke batch in a receiving container, according to which

- the coke-oven chamber of a heat-recovery or non-recovery-type coke-oven bank is charged with coal for carbonisation, this coal being carbonised in operating cycles, and
- the coke is pushed by a pusher machine in form of a compact and solid coke cake after the carbonisation process from the coke-oven chamber into the receiving container of a quenching car, and
- the coke is transported in the quenching car to a quenching tower where it is cooled to ambient temperature by means of a cooling agent, and which is characterised in that

- movable segments of a plate are moved or lifted against one another above the bottom of the receiving container by at least one controllable driving unit shortly before or during the quenching process,
- so that the fresh coke batch rips up and forms additional gaps, channels and clear edge areas in the coke into which the cooling agent can flow from the cooling agent nozzles arranged above, and the cleared areas of the coke batch can be wetted by the cooling agent.

As the coal batch breaks up on account of the movement of the movable segments of the plate on the bottom of the receiving container, the cooling agent can reach the cleared partial areas of the coke cake, the total surface area of which is considerably enlarged by the break-up of the coal cake. In this way the quenching process is a lot more intensive. At the same time the pollution is reduced as the harmful ash and coke dust whirled up by the break-up of the batch is already washed out by the water trickling down from the vaporous atmosphere in the quenching tower and hence does not get into the environment. If required, the ash and coke dust can later be submitted to a downstream treatment in the sedimentation basin.

DETAILED DESCRIPTION OF THE PREFERRED EMBODIMENTS

According to an embodiment of the invention the surface segments are designed such that they can be moved horizontally against one another in longitudinal or transversal direction of the bottom of the receiving container. For this, at least one of the surface segments is pulled out of its resting position by 5 to 400 mm. In another embodiment of the invention the surface segments can be moved against one another in vertical direction, and at least one of these surface segments can be lowered or lifted from its resting position by 5 to 600 mm. A flat-bed quenching car of a heat-recovery or non-recovery coke-oven system normally has a car width between 2.0 and 4.5 m and a car length between 10 and 16 m.

The surface segments can also break up the coke batch in vibratory operation. The vibratory process can be in any direction desired. Vibrations can, for example, be in horizontal direction or in vertical direction. The segments are, for example, vibrated vertically or horizontally at a frequency of 50-70 Hz so that the coke batch breaks up by the vibratory operations. The vibration frequency is optional, however.

The nozzles for the cooling agent in the quenching tower can be arranged as desired. Preferably, however, they are arranged such to ensure that the cooling agent easily reaches the coke cake broken up by the movable segments. According to an exemplary embodiment they are arranged in the quenching tower above the quenching car with the receiving container. The nozzles for the cooling agent can also be arranged above the quenching car with the receiving container so that they can be moved along the nozzle level of the quenching tower so that they can be adapted to meet the requirements of the quenching process. For this purpose, the nozzles in the quenching tower can be shifted to practically any position desired. According to another exemplary embodiment they are arranged in the quenching tower above the quenching car with the receiving container and adjusted such that they are arranged above the pre-estimated position of the forming gaps, channels and clear edge areas. The breaking points of the coke cake can usually be pre-estimated easily by the movement of the segments and the location of the segments before the coke cake breaks up.

The cooling agent is preferably water. However, the cooling agent used can also be a cooling combustion-inert gas.

Claim is also laid to a contrivance for breaking up a fresh and hot coke batch in a receiving container, consisting of

- a horizontal coke-oven chamber as a part of a heat-recovery or non-recovery-type coke-oven bank with coke-oven chamber doors at the front end,
- a receiving container provided on or in a quenching car for fresh coke, the coke quenching car allowing to be moved in parallel to and along the coke-oven chamber front,
- a quenching tower under which the quenching car can be moved by a transport device, and characterised in that

- the quenching tower is provided with one or several nozzles for ejecting cooling agent onto the coke cake which is temporarily contained in the receiving container of the quenching tower underneath, and
- a plate is provided above the bottom of the receiving container, the plate being subdivided into movable segments, and the segments being movable against one another by a controllable driving unit, and
- these segments are coated with a heat-resistant material or made of a heat-resistant material to ensure that they withstand the high temperatures of the glowing coke.

The segments can be designed such that they seal the coke cake automatically against the bottom plate of the receiving container. The segments can be provided in an overlapping or meshing arrangement. The segments can theoretically be of any shape desired but preferably allow seamless intermeshing. According to a conceivable embodiment the segments are made of teflon material, which serves to improve the sliding properties of the segments for the coke.

According to an embodiment of the invention the segments can advantageously also be sealed against one another by means of sealing material. In this way coke is prevented from intrusion between the segments and the bottom plate and the wall of the receiving container is protected against the coke. Coke is also prevented from exiting through any inlet ports from the receiving container of the quenching car. The segments can also have a sealing material or sealing elements on the transitional surfaces.

The way in which the force required to move the segments is generated and transmitted is optional. According to an embodiment of the inventive contrivance movement is ensured by frictional connection of the segments with rods or chains for force transmission. According to another embodiment of the invention movement is ensured by frictional connection of the segments with at least one drive shaft for force transmission. The force-transmitting devices can be attached to the segments in any way desired. The force-transmitting devices can, for example, be provided with hooks and the segments with lugs via which the force can be transmitted. The force can also be transmitted via rods which are provided with an annular connecting element to ensure that the connection is adequately flexible.

The force-transmitting devices can be led into the receiving container and into the quenching car in any way desired. They can, for example, be led through ports in the bottom of the receiving container of the quenching car. The force-transmitting devices, however, can also be led through ports in the lateral wall of the receiving container of the quenching car.

According to a preferable embodiment the driving units for moving the surface segments are installed on the quenching car. However, they can also be integrated permanently into the lateral surfaces of the quenching tower. According to an advantageous embodiment the force required for moving the movable segments is transmitted via force-transmitting devices through ports in the walls or the bottom of the quenching car/s, after the latter have entered the quenching tower.

The way in which the driving force for the segments is generated is likewise optional. The force-transmitting devices can be connected to one or several extensible cylinder/s driving these devices so to ensure that the surface segments are moved. According to an advantageous embodiment the force-transmitting devices are connected to one or several extensible cylinder/s, such cylinders being installed on the quenching car. According to another embodiment the force-transmitting devices are connected to one or several extensible cylinder/s, these cylinders being installed on the lateral walls of the quenching tower. The extensible cylinders can, for example, be moved hydraulically. The optional extensible cylinders can, however, also be moved pneumatically. Last but not least the extensible cylinders can also be moved electrically.

The invention involves the advantage of providing a method which allows quenching and cooling of the glowing coke in the quenching tower while preventing uneven temperature distribution or water content in the coke batch and at the same time reducing the pollution, as the harmful ash and coke dust whirled up by the breaking-up of the batch is already washed out by the water trickling down from the vaporous atmosphere in the quenching tower and hence does not get into the environment. Thus a method is provided which supports the process of quenching a coke cake during the quenching in the quenching tower in an ecologically active manner, so that the quenching process can be adapted to meet the conditions of the coke cake and of the quenching tower.

The invention is illustrated in more detail by means of nine drawings, the inventive method not being limited to these embodiments.

FIG. 1 shows a closed arrangement (1*a*) of segments (2) according to the invention which are intermeshing and thus forming a closed plate.

Figure 1:
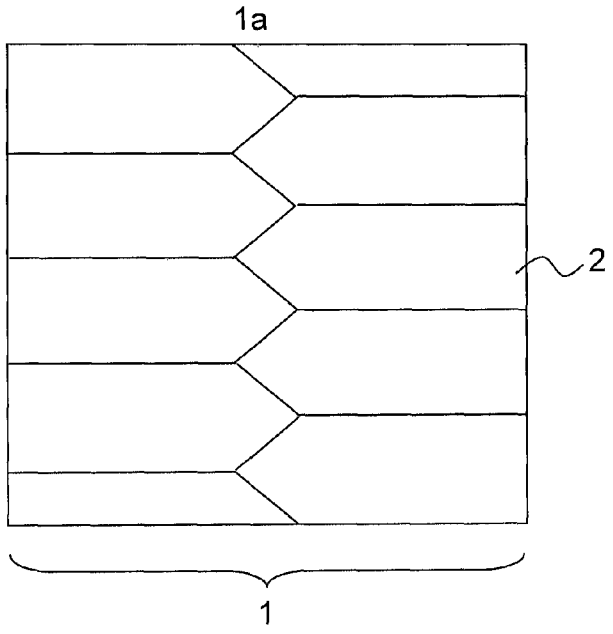
FIG. 1 shows a closed arrangement of movable segments according to the invention.
Figure 2:
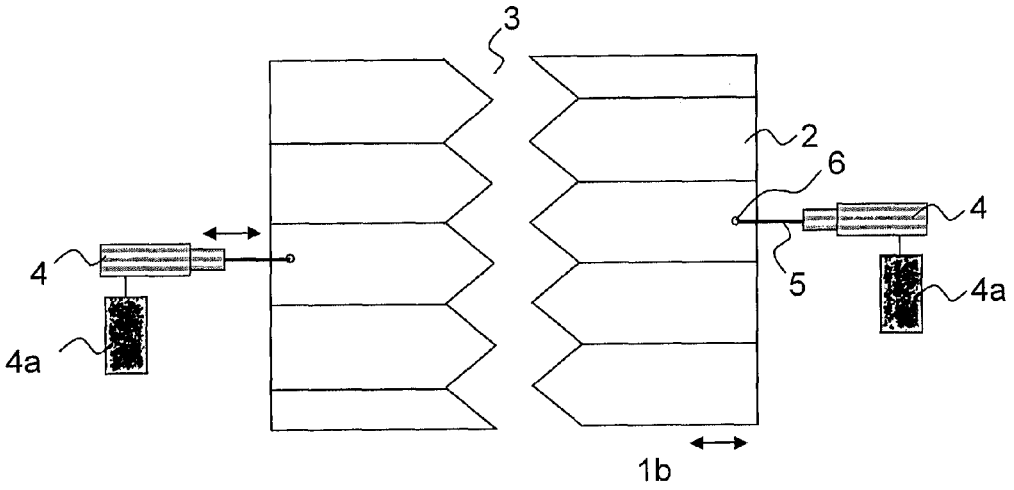
FIG. 2 shows an open arrangement of movable segments according to the invention.

FIG. 2 shows an open arrangement (1*b*) of segments (2) according to the invention. The segments (2) have been pulled apart so that a gap (3) has formed in the middle of the plate. The segments (2) can be moved in horizontal direction. Also shown is an extensible cylinder (4) for generating the movement, the cylinder being operated by a motor (4*a*) for generating the force. The force is transmitted from the cylinder (4) to the segments (2) via a rod (5) fixed in a lug (6) of the segments (2).

Figure 3:
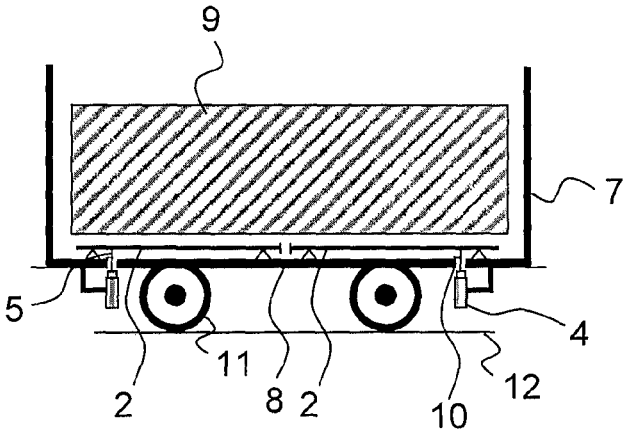
FIG. 3 shows a quenching car which is provided with an arrangement of two movable segments above the bottom of the receiving container.

FIG. 3 shows a quenching car (7) provided with an arrangement of two movable segments (2) above the bottom of the receiving container (8). At the bottom (8) of the quenching car (7) there are two movable segments (2) of a plate in closed condition. On top of the segments (2) there is a coke cake (9). Below the quenching car (7) there are two extensible cylinders (4) which serve to generate a force, these cylinders moving the segments (2) via a rod (5) and a port through the bottom of the receiving container (10) of the quenching car in horizontal direction. The quenching car (7) is represented in front view before a coke-oven chamber (not shown). The quenching car (7) is carried by wheels (11) on rails (12).

Figure 4:
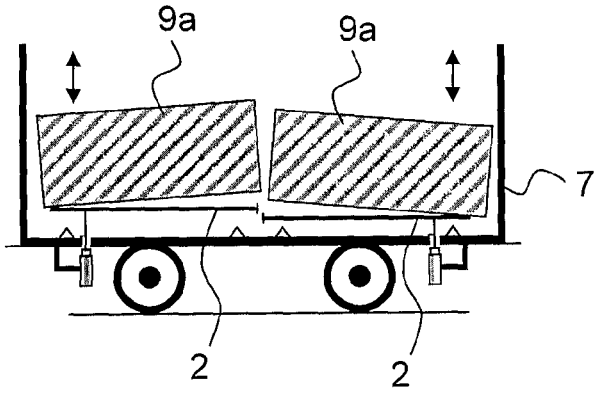
FIG. 4 shows the same quenching car with the segments in motion to break up the coke cake.

FIG. 4 shows the same quenching car (7) with the segments (2) in vertical motion to break up the fresh coke cake (9) into two partial batches (9*a*).

Figure 5:
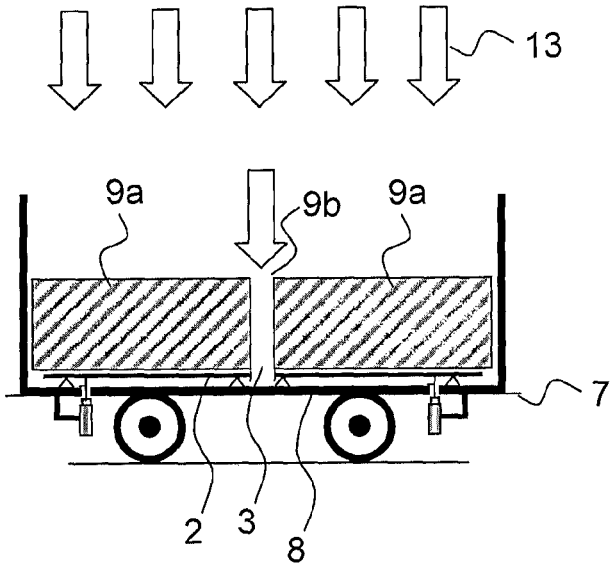
FIG. 5 shows a quenching car provided with an open arrangement of two movable segments above the bottom of the receiving container.

FIG. 5 shows a quenching car (7) which is provided with an open arrangement (1*b*) of two movable segments (2), i.e. with a gap in between (3), above the bottom of the receiving container (8). The coke cake contained (9) has broken up into two parts (9*a*) so that the quenching water (13) can freely flow into the channel (9*b*) between the partial batches (9*a*) of the coke cake (9).

Figure 6:
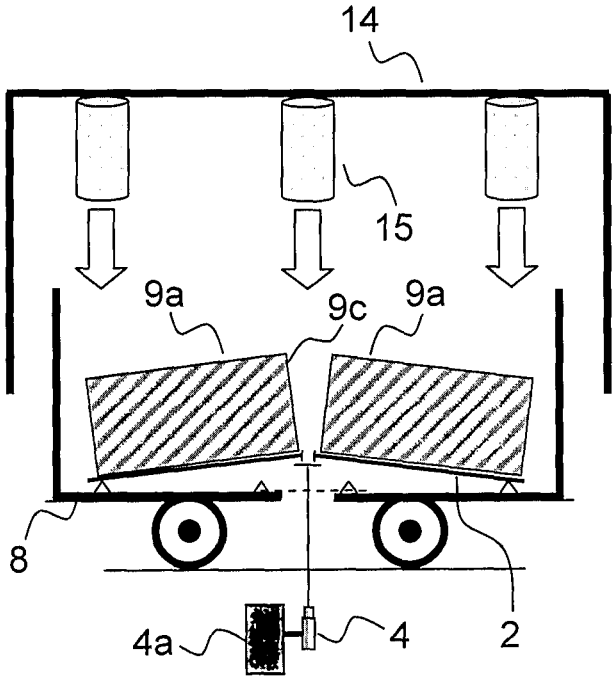
FIG. 6 shows the front view of a quenching car with the inventive segments, the quenching car standing under a quenching tower.

FIG. 6 shows the front view of a quenching car (7) with the inventive segments (2), the car standing under a quenching tower (14). A rod (5) leads through the bottom of the quenching car or receiving container (8) and pushes the segments upwards (2) so that the coke cake (9) breaks up into two parts (9*a*). The upper part of the quenching tower (14) is fitted with nozzles (15) which are exactly adjusted to the clear areas (9*c*) of the broken-up coke cake. In this way the coke cake (9) can cool down more quickly.

Figure 7:
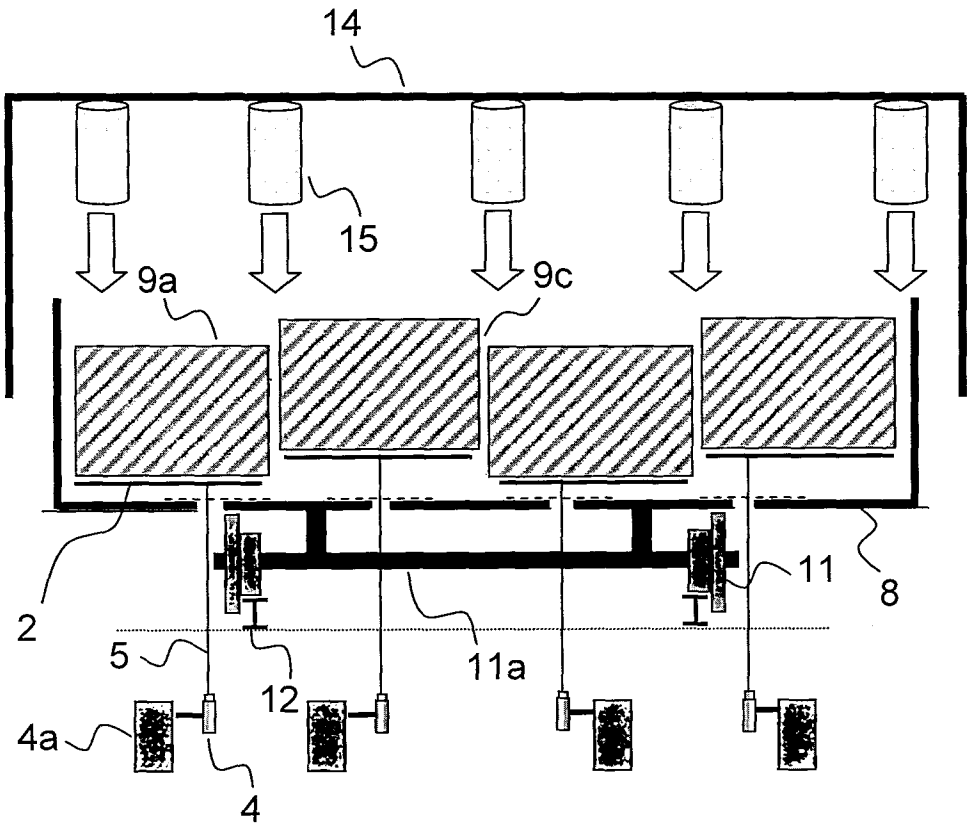
FIG. 7 shows a lateral view of the same quenching car with the inventive segments.

FIG. 7 shows a lateral view of the same quenching car (7) with the inventive segments (2). The figure shows the wheels (11) of the quenching car (7), the axle (11*a*) bearing the wheels (11) and the rail (12) bearing the wheels (11). Underneath the quenching car (7) there are four cylinders (4) for generating the force required for moving the segments (2). Here, the force is transmitted, for example, via rods (5) which are arranged through inlet ports (10) in the bottom of the receiving container (8) of the quenching car (7). The coke cake (9) has broken up longitudinally into four parts so that the nozzles (15) which are provided in the upper part of the quenching tower (14) can be adjusted exactly towards the clear areas (9*c*) of the broken-up coke cake (9). The breaking points of the coke cake (9) can be predetermined exactly by the position of the segments (2).

Figure 8:
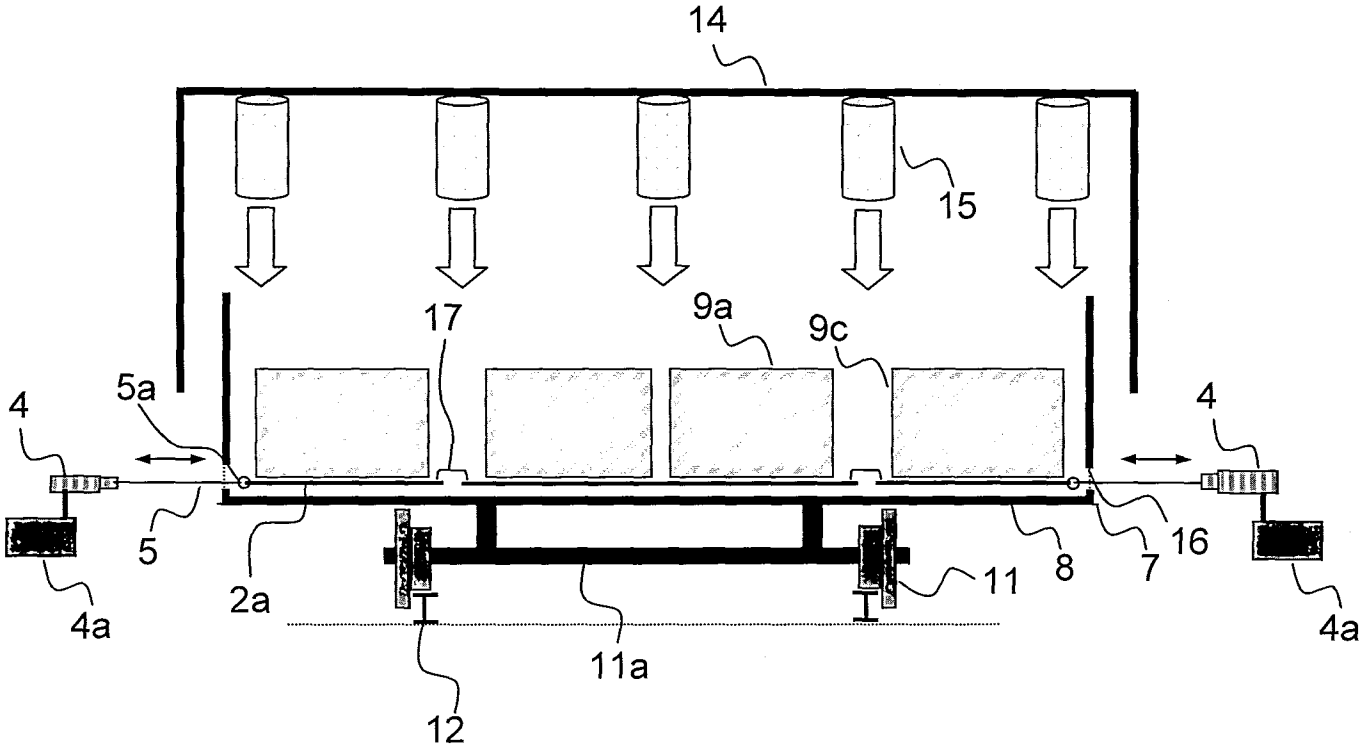
FIG. 8 shows a lateral view of a quenching car standing under a quenching tower with adjusted arrangement of the nozzles, the force-transmitting devices being led through ports in the wall of the quenching car.

FIG. 8 shows a lateral view of a quenching car (7) standing under a quenching tower (14) with adjusted arrangement of the nozzles (15), the devices for transmitting the force leading through ports (16) in the lateral wall of the receiving container (8) of the quenching car (7). The movable segments (2) are arranged above the bottom of the receiving container (8) and are moved by two extensible cylinders (4). The force is transmitted by rods (5) provided with an annular connecting element (5*a*) so to establish a connection that is adequately flexible. The lateral segments (2*a*) are moved in longitudinal direction of the coke cake (9) so that the coke cake breaks up into several partial batches (9*a*). The figure shows a total of four partial batches (9*a*) of the coke cake (9) so that the nozzles (15) which are installed in the upper part of the quenching tower (14) can be adjusted exactly towards the clear areas (9*c*) of the broken-up coke cake (9). The figure shows a sealing element (17) between the segments (2).

Figure 9:
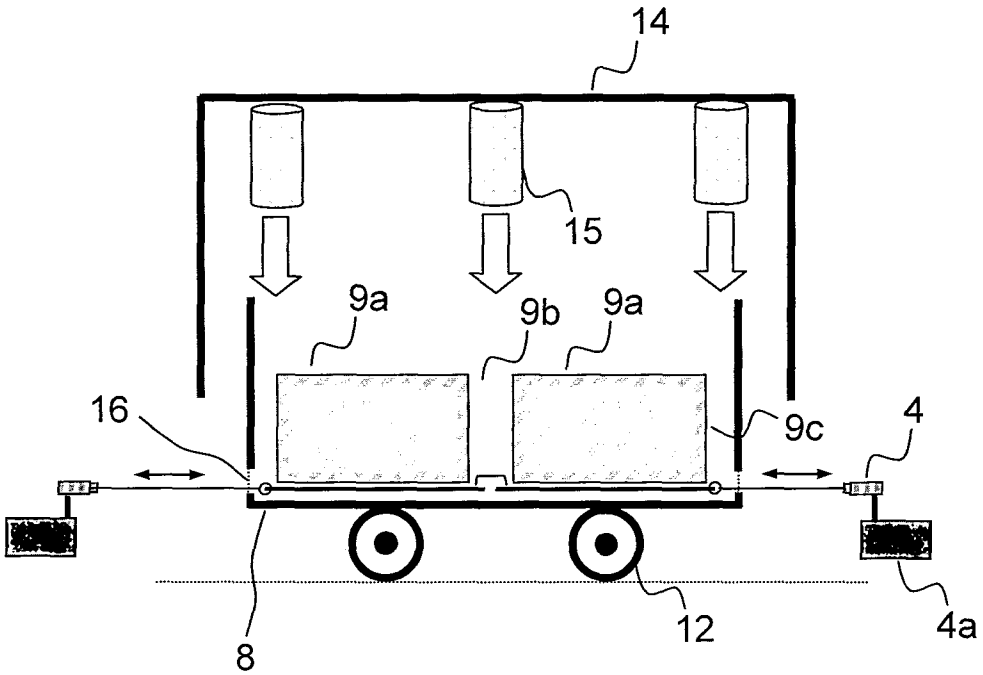
FIG. 9 shows a lateral view of the same quenching car which is provided with segments to be opened crosswise.

FIG. 9 shows a lateral view of the same quenching car (7) which is equipped with segments (2) to be opened crosswise. They are pulled out of the receiving container (8) towards the front. The figure shows two partial batches (9*a*) of the coke cake (9) so that the nozzles (15) provided in the upper part of the quenching tower (14) can be adjusted exactly towards the channels (9*b*) and clear areas (9*c*) of the broken-up coke cake (9*a*).

LIST OF REFERENCE NUMBERS AND DESIGNATIONS

1 Arrangement of segments
1*a* Closed arrangement of segments
1*b* Open arrangement of segments
2 Segment
3 Gap between the segments
4 Extensible cylinder
4*a* Motor for generating segment moving force
5 Force-transmitting rod
5*a* Annular connecting element
6 Lug in the segments
7 Quenching car
8 Receiving container
9 Coke cake
9*a* Partial batches of the coke cake
9*b* Channel through partial batches of the coke cake
9*c* Clear areas of the coke cake
10 Port through the bottom of the receiving container
11 Wheels of the quenching car
11*a* Axle of the quenching car
12 Rails
13 Quenching water
14 Quenching tower
15 Nozzles for quenching water
16 Lateral ports in the wall of the receiving container
17 Sealing element

The invention claimed is:

1. In a method for producing coke by the coking of coal in a coke oven chamber of a heat-recovery or non-recovery coke oven bank having a pusher machine for pushing coke from the coke oven chamber, the coke being in the form of a compact and solid coke cake, and wherein the compact and solid coke cake is pushed onto a receiving container of a quenching car and transported to a quenching tower for cooling by means of a cooling agent, the improvement comprising:

providing the receiving container of the quenching car with a plate positioned above a bottom of the receiving container, the plate comprising a plurality of moveable segments moveable with respect to other segments of the plate, pushing a compact and solid coke cake onto the plate, and moving one or more segments of the plate relative to other segments such that the coke cake breaks up to form new gaps, channels and clear edge areas in the compact and solid coke into which cooling agent can flow from cooling agent nozzles from above the quenching car in the quenching tower such that a greater portion of the coke cake can be wetted by the cooling agent.

2. The method of claim 1, wherein the segments are configured to move horizontally relative to one another in a longitudinal or a transverse direction relative to the bottom of the receiving container, and at least one segment is moved from a resting position proximate the bottom of the receiving container by over distance of from 5 mm to 400 mm.

3. The method of claim 1, wherein at least one segment is moveable with respect to other segments in a vertical direction, and during the step of moving, the at least one segment is raised or lowered from a rest position over a distance of from 5 mm to 600 mm.

4. The method of claim 1, wherein segments are moved by causing segment(s) to vibrate vertically or horizontally such that the coke cake breaks up by a vibratory motion of the segment(s).

5. The method of claim 1, wherein the cooling agent nozzles are moveable along a nozzle level of the quenching tower.

6. The method of claim 1, wherein cooling agent nozzles of the quenching tower are positioned above areas of the coal cake expected to form gaps, channels and clear edge areas.

7. The method of claim 1, wherein the cooling agent comprises water.

8. In a device for producing coke by the coking of coal in a coke oven chamber of a heat-recovery or non-recovery coke oven bank having a pusher machine for pushing coke from the coke oven chamber, the coke being in the form of a compact and solid coke cake, and wherein the compact and solid coke cake is pushed onto a receiving container of a quenching car and transported to a quenching tower for cooling by means of a cooling agent, the improvement comprising:

a quenching car comprising a receiving container dimensioned for receiving a fresh and hot, compact and solid coke cake from the coke oven chamber, the receiving container having a bottom, and comprising a plate positioned above the bottom of the coke receiving container, the plate comprising segments which are independently moveable with respect to each other, and a plurality of controllable driving units which move a corresponding plurality of segments independently of other segments and facilitate a breaking up of the compact and solid cake by virtue of relative movement of the segments, each segment being constructed of a material which withstands a high temperature of the fresh and hot coke, or is coated with such material.

9. The device of claim 8, wherein the segments are provided in an overlapping or meshing arrangement.

10. The device of claim 8, wherein the segments comprise Teflon material.

11. The device of claim 8, wherein the segments are sealed against one another by means of a sealing material or have a sealing material on transitional surfaces.

12. The device of claim 8, wherein the segments are moved by transmission of a moving force by rods or chains.

13. The device of claim 8, wherein the segments are moved by transmission of a moving force by a drive shaft.

14. The device of claim 8, wherein the segments are moved by transmission of a moving force by a rod provided with an annular connecting element which provides a flexible connection between the rod and a respective segment to which the rod is attached.

15. The device of claim 8, wherein force transmitting devices which move segments pass through ports in the bottom of the receiving container.

16. The device of claim 15, wherein force is applied to the force transmitting devices by an extensible cylinder which is driven hydraulically, pneumatically, or electrically.

17. The device of claim 16, wherein the extensible cylinders are mounted on the quenching car.

18. The device of claim 16, wherein the extensible cylinders are installed on lateral walls of a coke quenching tower.

19. The device of claim 8, wherein force transmitting devices which move segments pass through ports in a lateral wall of the receiving container.

20. The device of claim 19, wherein force is applied to the force transmitting devices by an extensible cylinder which is driven hydraulically, pneumatically, or electrically.

21. The apparatus of claim 20, wherein the extensible cylinders are mounted on the quenching car.

22. The device of claim 20, wherein the extensible cylinders are installed on lateral walls of a coke quenching tower.

* * * * *